United States Patent [19]

Lane

[11] Patent Number: 4,897,974

[45] Date of Patent: Feb. 6, 1990

[54] VENT PIPE ROOF MOUNT

[76] Inventor: Byron D. Lane, Hwy. 2, Box 257, Sawyer, N. Dak. 58781

[21] Appl. No.: 293,354

[22] Filed: Jan. 4, 1989

[51] Int. Cl.[4] ..... E04B 7/00

[52] U.S. Cl. ..... 52/199; 52/58; 52/219; 285/43

[58] Field of Search ..... 52/58, 199, 219; 285/42, 43

[56] References Cited

U.S. PATENT DOCUMENTS

| | | | |
|---|---|---|---|
| 1,127,844 | 2/1915 | Anderson | 52/219 |
| 1,342,918 | 6/1920 | Legg | 52/219 X |
| 2,592,084 | 9/1952 | Van Alstyne | 52/58 X |
| 2,706,395 | 4/1955 | McCrea | 52/219 |
| 3,602,468 | 8/1971 | Stone | 52/219 X |
| 3,797,181 | 3/1974 | Nievelt | 52/199 X |
| 3,809,350 | 5/1974 | Lane | 52/219 X |

*Primary Examiner*—David A. Scherbel
*Assistant Examiner*—Creighton Smith
*Attorney, Agent, or Firm*—Fleit, Jacobson, Cohn, Price, Holman & Stern

[57] ABSTRACT

A vent pipe roof mount that is attached directly to the inclined roof and forms the sole support for a vertical vent pipe extending through the roof with the roof mount simplifying the installation of a vent pipe since cutting the hole in the roof, installing the roof mount and installing the roof jack can all be done in one operation while on the upper surface of the roof with the roof mount of this invention also eliminating any other hanging support device for the vent pipe with this device being especially useful in houses that do not have a basement. The roof mount includes a generally flat, horizontally disposed plate with a central aperture defined by a plurality of tabs with a bracket at one edge of the plate and elongated supporting straps at the other with the bracket and straps being engaged with the side edges of a hole formed in the inclined roof and being attached thereto with the bracket being attached to the lower edge of the opening and the straps being adjustably connected to the upper edge of the roof opening in order to position the plate in a horizontal manner with the tabs engaging and supporting the vent pipe extending therethrough.

7 Claims, 1 Drawing Sheet

VENT PIPE ROOF MOUNT

BACKGROUND OF THE INVENTION

Field of the Invention

This invention generally relates to a support for pipes, vents, flues and other similar tubular members extending vertically through an inclined roof and more particularly to a vent pipe roof mount that is attached directly to the inclined roof and forms the sole support for a vertical vent pipe extending through the roof with the roof mount simplifying the installation of a vent pipe since cutting the hole in the roof, installing the roof mount and installing the roof jack can all be done in one operation while on the upper surface of the roof with the roof mount of this invention also eliminating any other hanging support device for the vent pipe with this device being especially useful in houses that do not have a basement. The roof mount includes a generally flat, horizontally disposed plate with a central aperture defined by a plurality of tabs with a bracket at one edge of the plate and elongated supporting straps at the other with the bracket and straps being engaged with the side edges of a hole formed in the inclined roof and being attached thereto with the bracket being attached to the lower edge of the opening and the straps being adjustably connected to the upper edge of the roof opening in order to position the plate in a horizontal manner with the tabs engaging and supporting the vent pipe extending therethrough.

INFORMATION DISCLOSURE STATEMENT

My prior U.S. Pat No. 3,809,350 issued Mar. 7, 1974 discloses a plate having a central opening with tabs engaging a vent pipe extending therethrough with the plate being perpendicular to the longitudinal axis of the vent pipe and supported from horizontal joists or similar supporting structures. Various efforts have been made to support pipes, vent pipes, flues and the like with the following U.S. patents relating generally to this field of endeavor.

1,127,844
1,342,918
2,706,395
3,602,468

None of the above-mentioned patents discloses an arrangement in which a support plate with a central opening and tabs is supported horizontally directly from an opening formed in an inclined roof with the tabs supporting a vertically disposed vent pipe so that the vent pipe is suspended in vertical position through a hole formed in the inclined roof thereby eliminating the use of support structures adjacent the bottom of the vent pipe.

SUMMARY OF THE INVENTION

An object of the present invention is to provide a roof mount for a vent pipe extending through an opening in an inclined roof with the roof mount including a horizontally disposed plate having a central opening defined by a plurality of resilient metal tabs positioned horizontally and below the roof opening with the vent pipe extending vertically therethrough in which the plate includes a bracket at one edge and elongated straps at the other to support the plate horizontally below the inclined roof.

Another object of the invention is to provide a roof mount in accordance with the preceding object in which the bracket is vertically spaced from the plate a distance substantially less than the length of the straps for connection with the lower edge of the opening in the roof with the straps being elongated and capable of attachment to the upper edge of the roof in an adjustable manner to effectively support the plate in horizontal position and in alignment with the roof opening to form the sole means for supporting a vertically extending vent pipe which extends through the roof to a desired extent and which extends downwardly into the house to a desired level without any additional support for the weight of the vent pipe thereby rendering the roof mount especially effective in houses without basements.

A further object of the invention is to provide a roof mount in accordance with the preceding objects in which the entire installation operation can be performed at the same time from a point above the upper surface of the roof by first cutting a roof opening, installing the roof mount and vent pipe and then installing the roof jack and providing waterproof integrity between the roof covering and roof jack by standard roofing procedures thereby greatly reducing the time and effort necessary to support a vent pipe vertically through an opening in an inclined roof.

Yet another important object of the invention is to provide a roof mount which greatly simplifies the installation of a vent pipe vertically through an inclined roof with the roof mount being accompanied by a template to facilitate the cutting of the hole in the roof and instructional material to indicate the procedural steps followed in installing the roof mount, vent pipe and roof jack.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
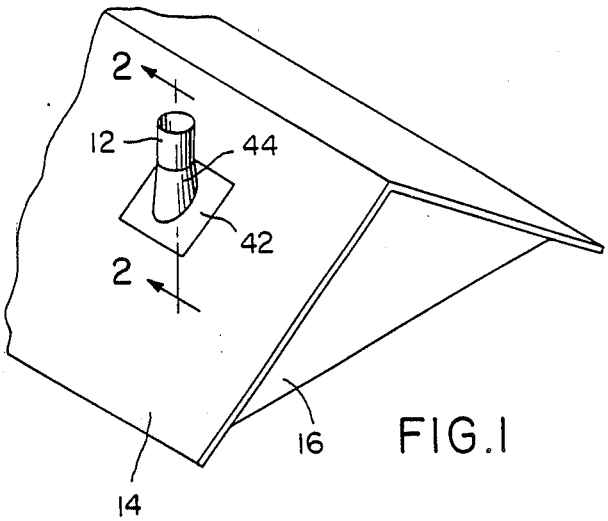
FIG. 1 is a perspective view of a vent pipe installed in an inclined with the roof jack in place.

The roof mount of the present invention is generally designated by reference numeral 10 and has for its purpose the support of a vent pipe 12 or similar tubular member such as a smoke pipe, flue or the like which extends vertically through the inclined roof 14 of a house or other building 16 and is especially useful in association with houses which do not include a basement with the roof mount 10 forming the support for the vent pipe 12.

The roof mount 10 includes a horizontally disposed plate 18 of sheet metal or the like having a central aperture 20 formed by a plurality of resilient tabs 22 which have their outer ends secured to the periphery of an opening 24 formed in the plate 18 so that the tabs 22 due to their resiliency and flexibility will securely grip and support the exterior surface of the vent pipe 12. The structure of the tabs, their association with the surface of the vent pipe and the manner in which they are rigidly fixed to the plate 22 is disclosed in my prior U.S. Pat. No. 3,809,350.

Figure 2:
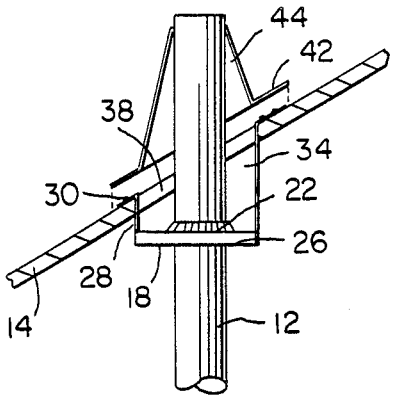
FIG. 2 is a vertical, sectional view taken substantially upon a plane passing along section 2—2 on FIG. 1 illustrating structural of the installation.

The plate 22 includes an integral, relatively short peripheral flange 26 perpendicular to the plate 22 which rigidifies and reinforces the sheet metal plate 18. The plate 18 is preferably square in configuration and the aperture 24 is centralized as is the opening 20 defined by the tabs 22. One side of the plate 18 is provided with an upstanding flange or bracket 28 that is continuous from edge-to-edge of the plate 18 and the upper edge of the flange or bracket 28 extends laterally outwardly as a flange 30 provided with a plurality of apertures 32 therethrough with the flange 30 being disposed against the upper surface of the roof 14 as illustrated in FIG. 2 and secured to the roof 14 by fastening devices such as nails.

Figure 3:
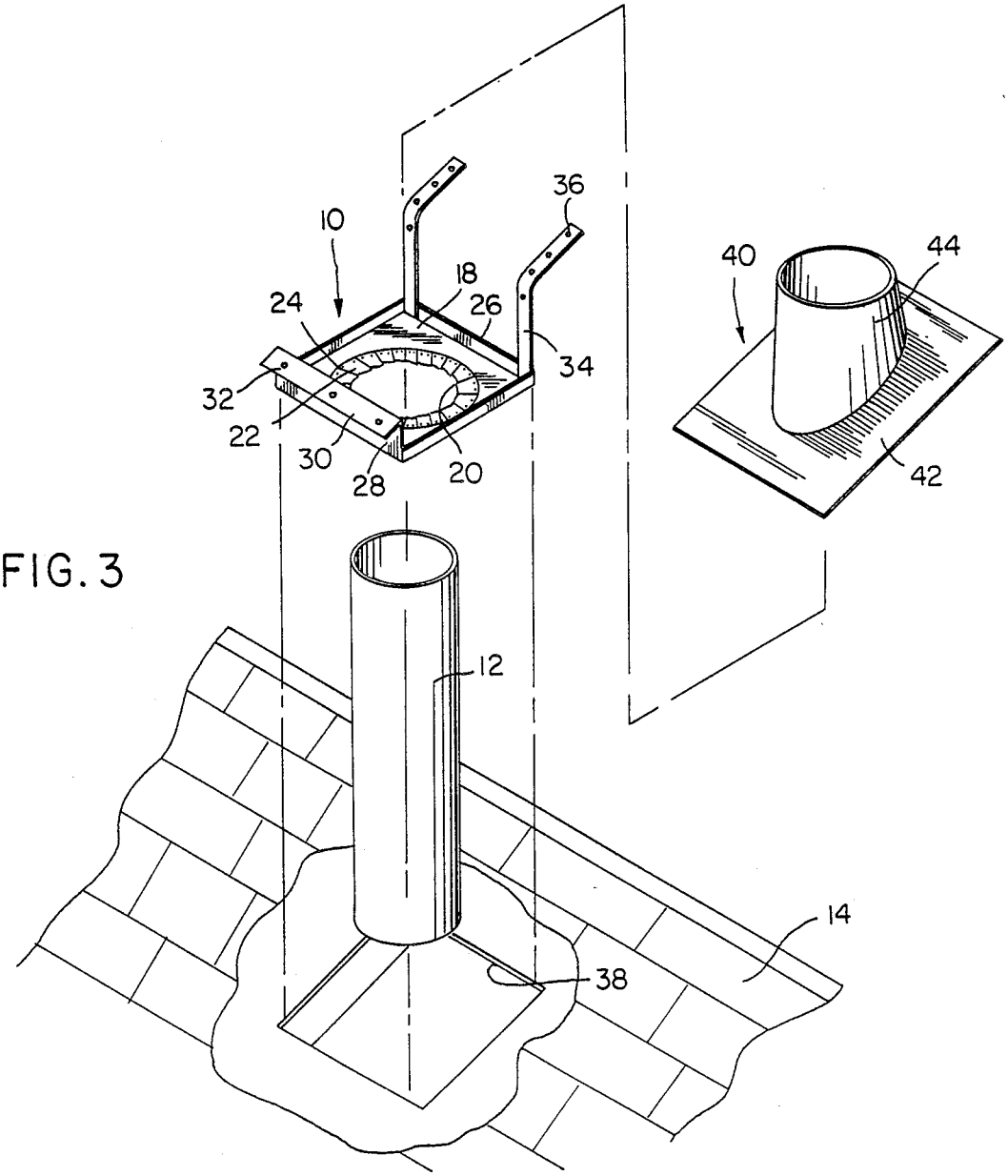
FIG. 3 is an exploded, group perspective view of the roof mount of the present invention and its associated components including the inclined roof, opening, vent pipe and roof jack.

At the opposite edge of the plate 18, a pair of upwardly extending straps 34 are provided with the straps being relatively narrow and secured to the outer end edges of the flange 26 opposite the continuous flange or bracket 28. The straps 34 are also constructed of sheet metal and provided with a plurality of longitudinally spaced apertures 36 therein with the straps 34 being bendable so that the upper ends thereof will be bent outwardly into overlying engagement with the roof 14 with fasteners extending through the apertures 36 to securely mount the plate 18 from the roof 14 with the plate 18 being maintained in horizontal position by adjusting the point of connection of the straps 34 with the roof 14 thereby orienting the plate 18 in horizontal position with the tabs frictionally locking the vent pipe 12 in place as illustrated in FIGS. 2 and 3.

As illustrated, an enlarged hole 38 is formed in the roof 14 which is of a size to enable the roof mount to be moved vertically down through the opening 38 and the roof mount secured in place thereby enabling the hole 38 to be formed in the roof 14 and the roof mount 10 inserted down through the opening 38 and mounted in place on the roof with this entire operation being performed by a person standing on the upper surface of the roof 14 thereby greatly simplifying the installation of the roof mount 10 and correspondingly simplifying the mounting and support of the vent pipe 12 by inserting it down through the roof mount 10.

When forming the opening 38 in the roof, a template is provided based upon the pitch of the roof and the size of the vent pipe and roof mount. The pitch of the roof can be determined by standard procedures well-known in the art with the template being secured to the roof 14 with different templates being provided for different diameter vent pipes. With the center of the template aligned with the center of the hole to be formed in the roof, the template is secured in place and used as a guide to cut the hole 38. Typically, the roof mount for a 6" vent pipe is 10"×10" and by use of the template, the length of the inclined opening to enable vertical movement of the roof mount 10 downwardly through the opening will be 11 ½". The length dimension of the opening will vary depending upon the pitch of the roof. If smaller or larger roof mounts are used for different sized vent pipes, different templates will be provided since the side dimensions of the square roof mount will vary depending upon the size of the vent pipe to be supported. After the roof mount 10 is placed in position and the vent pipe 12 also supported in the manner illustrated in FIG. 2, a roof jack 40 is placed over the vent pipe and slid downwardly. The roof jack 40 includes a plate 42 and a generally conical tubular member 44. The plate should be initially positioned in spaced relation above the roof to enable the roofer to shingle the roof in and the sheet metal plate or panel 42 and the tubular member 44 then will be lowered and secured in place and sealed to the roof in a conventional manner.

By using the roof mount of the present invention, the entire installation may be made from a position on the upper surface of the roof 14 with the hole 38 being formed, the roof mount 10 and vent pipe 12 being installed and the roof jack 40 then being installed. It is preferable to push the roof mount downwardly over the pipe 12 before setting the pipe and the roof mount in the opening 38 thereby assuring that the tabs 22 will be deflected upwardly so that they will securely frictionally engage the periphery of the vent pipe 12 thereby supporting the vent pipe 12 solely from the roof mount 10. The roof mount will be made in different sizes to support vent pipes or tubular members ranging from about 3" in diameter to 14" in diameter and will produce an effective support for a vent pipe thereby eliminating the necessity of support structures for the lower end of the vent pipe thereby facilitating the support and installation of vent pipes, flues and the like in houses with the roof mount especially adapted for supporting vent pipes in houses without basements. When the roof mount is installed, it will help maintain an automatic fire clearance between the roof and vent pipe and also serve as a fire stop with the roof jack closing the opening 38 so that the space below the roof will not be communicated with exterior atmospheric conditions.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A roof mount for supporting a vertically disposed tubular member from an inclined roof in which the tubular member extends through an opening in the roof that is larger than the tubular member and includes an upper edge and a lower edge, said roof mount comprising a substantially flat plate having a central opening through which the tubular member extends, said central opening including a plurality of inwardly extending tabs attached to the plate around the periphery of the opening and extending radially inwardly, said tabs being constructed of sheet material having substantial rigidity but sufficient flexibility and resiliency to be deflected by insertion of the tubular member through the opening for frictionally engaging and supporting the tubular member from the plate, and means at opposite edge portions of the plate to support the plate from the upper and lower edges of the opening through the roof with the plate being substantially horizontally disposed and the central opening in alignment with the opening in the roof thereby positioning the tubular member in the opening in the roof in spaced relation to the periphery of the opening in the roof, said means supporting the plate from the lower edge of the opening in the roof including an upwardly extending flange integral with the edge of the plate in alignment with the lower edge of the opening in the roof with the flange extending upwardly through the opening in contact with the lower edge of the opening and a laterally extending flange at the upper end of the upwardly extending flange with the laterally extending flange extending onto and engaging the top surface of the roof adjacent the lower edge of the opening and fastening means extending through the flange resting against the upper surface of the roof for securing the roof mount to the lower edge of the opening in the roof.

2. The structure as defined in claim 1 wherein said means securing the opposite edge portion of the plate to the upper edge of the opening in the roof including a pair of vertically extending, horizontally spaced straps attached to the plate and extending upwardly through the opening in contact with the upper edge of the opening, the upper ends of said straps being bendable into overlying relation to the upper surface of the roof adjacent the upper edge of the opening in the roof and fastening means extending through the portion of each strap engaged with the upper surface of the roof adjacent the upper edge of the opening in the roof thereby mounting the plate in horizontal position spaced below the opening in the roof.

3. The structure as defined in claim 2 wherein said straps are constructed of bendable sheet material having a plurality of longitudinally spaced apertures therein to enable the effective length of the portion of the straps between the opening and the plate to support the plate in horizontal position when the roof is inclined at different pitches.

4. The structure as defined in claim 2 wherein said plate, tabs, flanges and straps are constructed of sheet metal with the tabs having outer ends fixedly secured to the periphery of the opening in the plate and extending inwardly a predetermined distance to frictionally engage and support the tubular member.

5. The structure as defined in claim 4 wherein said plate is square with the flange at one edge thereof being continuous from side edge to side edge and the straps at the opposite edge thereof being positioned adjacent opposite ends of one side edge of the plate, said roof mount being insertable vertically, downwardly through the opening with the lengthwise dimension of the opening on the incline of the roof being greater than the length dimension of the plate so that the plate can be moved vertically downwardly through the roof opening when in horizontal position with the vent pipe supported by the plate.

6. In combination with an inclined roof, a vent pipe extending through an opening in the roof and a roof jack surrounding the vent pipe and engaging the inclined roof to form a closure for the opening in the roof with the opening in the roof including a high edge and a low edge and being substantially larger than the vent pipe, said opening including a periphery spaced from the vent pipe, a roof mount forming the sole support for the vent pipe, said roof mount including a horizontally disposed plate positioned below the roof and provided with means at opposite edges of the plate to engage the low edge and high edge of the opening in the inclined roof in a manner to support the plate in horizontal position below the inclined roof, said plate including an opening with the vent pipe extending therethrough in a vertical direction and extending through the opening in the roof with the periphery of the vent pipe spaced from the periphery of the opening, and means around the periphery of the opening in the plate to frictionally engage and support the vent pipe from the roof and forming the sole means for supporting the vent pipe thereby eliminating the necessity of providing a support for the lower end portion of the vent pipe to facilitate installation of a vent pipe in a house without a basement, said roof mount being installed from a position above the roof by cutting the roof to form an opening having a lengthwise direction along the inclination of the roof greater than the length between the edges of the plate having the means supporting the plate thereon thereby enabling installation of the vent pipe, roof mount and roof jack as well as the cutting operation to be performed from the upper surface of the roof.

7. A roof mount adapted to form the sole support for a vertically disposed vent pipe extending vertically through an opening in an inclined roof in which the opening is provided with opposed generally parallel edges and including an upper edge disposed at a higher elevation than a lower edge, said roof mount comprising a substantially flat plate having an opening therein adapted to receive the vent pipe therethrough, said opening in the plate including a plurality of tabs extending inwardly from the periphery thereof and adapted to frictionally contact and support the vent pipe, means on said plate in spaced relation to the opening therein adapted to supportingly engage the lower edge of the opening in the roof, and means on said plate in spaced relation to the opening therein adapted to supportingly engage the upper edge of the opening in the roof, said means being disposed on opposite sides of the opening in the plate, said means on the plate for engaging the lower edge of the opening in the roof including bracket means of fixed vertical length, said means on the plate for engaging the upper edge of the opening in the roof including bracket means of adjustable vertical length to support the plate in generally horizontal position regardless of the pitch of the roof, each of said bracket means including means enabling the bracket means to be fastened to the roof from the upper surface of the roof thereby enabling the roof mount and vent pipe to be installed from the upper surface of the roof with the roof mount forming the sole support for the vent pipe.

* * * * *